United States Patent [19]

Marynissen et al.

[11] Patent Number: 4,765,767

[45] Date of Patent: Aug. 23, 1988

[54] SNAP-ON CLIP FOR ELONGATED INSTRUMENTS

[75] Inventors: William E. Marynissen, Old Greenwich; Thomas T. Beeson, Fairfield; Thomas G. Snell, Madison, all of Conn.

[73] Assignee: BIC Corporation, Milford, Conn.

[21] Appl. No.: 761,991

[22] Filed: Aug. 1, 1985

[51] Int. Cl.[4] ..... B43K 25/00

[52] U.S. Cl. ..... 401/213; 24/11 R; 24/11 F; 401/131; 401/202; 401/243; 403/289

[58] Field of Search ..... 401/131, 194, 243–247, 401/104, 31, 251, 213, 202; D19/49, 48, 45; 24/10, 11; 273/80.4; 403/71, 289

[56] References Cited

U.S. PATENT DOCUMENTS

| | | | |
|---|---|---|---|
| D. 219,797 | 1/1971 | Shimano et al. | D74/17 |
| D. 239,112 | 3/1976 | Marynissen | D19/45 |
| D. 247,246 | 2/1978 | Verona | D19/45 |
| D. 260,101 | 8/1981 | Gomez | D19/51 |
| D. 273,397 | 4/1984 | Hechter | D19/49 |
| 421,614 | 2/1890 | Reid | 401/221 |
| 901,239 | 10/1908 | Hagan | 24/10 R |
| 1,285,030 | 11/1918 | Callison | 24/11 F |
| 1,594,410 | 8/1926 | Fischer et al. | 24/10 R |
| 1,784,605 | 12/1930 | Lynn | 24/11 F |
| 2,018,897 | 10/1935 | Reach | 273/80.4 |
| 2,189,963 | 2/1940 | Schoneberger | 24/11 F |
| 2,292,683 | 8/1942 | Bauer | 24/11 F |
| 2,338,947 | 1/1944 | Kovacs | 401/251 X |
| 2,473,688 | 6/1949 | Martin | 24/11 |
| 2,613,413 | 10/1952 | Budny | 24/10 R |
| 2,983,942 | 5/1961 | Hemstreet | 401/130 X |
| 3,194,564 | 7/1965 | Swan | 273/194 A |
| 3,453,694 | 7/1969 | Hechtle | 24/11 |
| 3,606,556 | 9/1971 | Green et al. | 401/247 |
| 3,608,154 | 9/1971 | Ira | 24/11 F |
| 3,802,788 | 4/1974 | Danjezek | 401/194 |
| 4,356,987 | 11/1982 | Schmid | 248/73 |
| 4,551,034 | 11/1985 | Zepell | 401/104 |

FOREIGN PATENT DOCUMENTS

| | | | |
|---|---|---|---|
| 862365 | 2/1971 | Canada | 401/40 |
| 3326678 | 1/1985 | Fed. Rep. of Germany | 401/131 |
| 501523 | 2/1939 | United Kingdom | 24/11 F |
| 810880 | 3/1959 | United Kingdom | 24/11 F |

*Primary Examiner*—Steven A. Bratlie
*Attorney, Agent, or Firm*—Pennie & Edmonds

[57] ABSTRACT

A clip assembly for an elongated instrument which includes a base portion, a resilient elongated member extending from the base portion and means extending from the base portion dimensioned for insertion into an aperture defined by the elongated instrument for snap-locking engagement therewith and attachment of the base portion thereto. In its preferred form the elongated instrument is a pen which includes a body member having a reservoir of writing medium and a writing tip, a cap member configured and dimensioned for mating engagement with the body member; and a clip. The clip includes a base portion, a resilient elongated member extending from the base portion; and means extending from the base portion configured and dimensioned for insertion into an aperture defined by the body or cap member of the writing instrument for snap-locking engagement therewith and attachment of the base portion thereto. The base portion and resilient elongated member are configured and dimensioned such that attachment of the base portion to the body or cap member of the writing instrument will retain the elongated member in generally parallel and sufficiently close proximity to the writing instrument for attachment of the writing instrument to wearing apparel or the like.

23 Claims, 2 Drawing Sheets

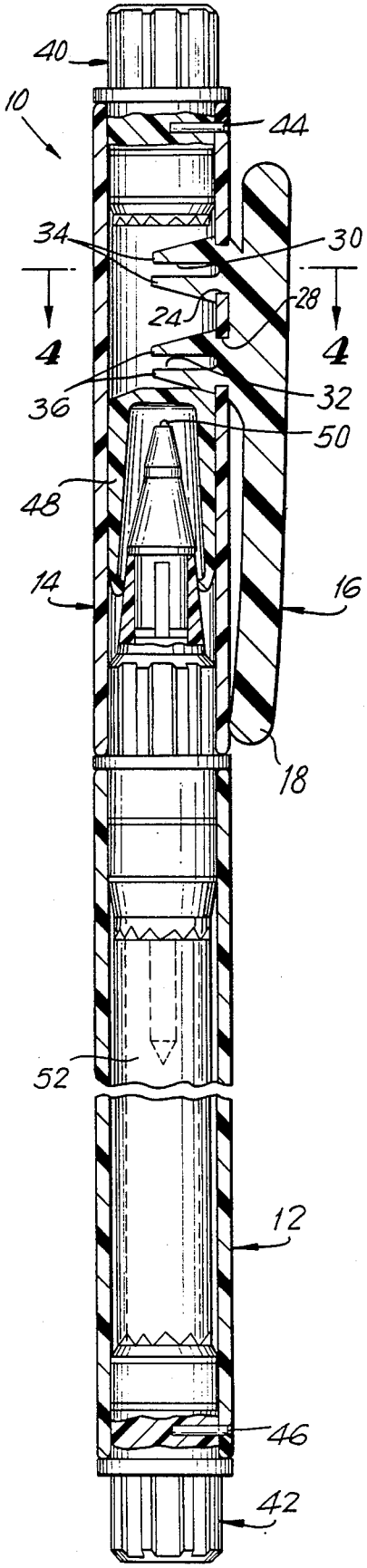
FIG. 3
FIG. 3A
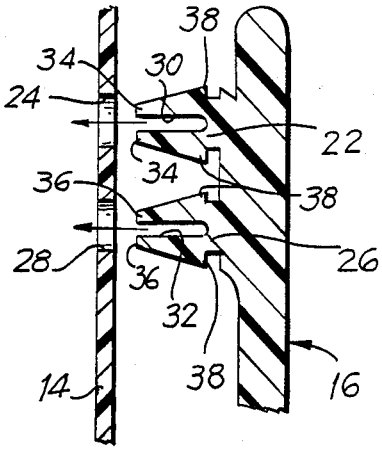
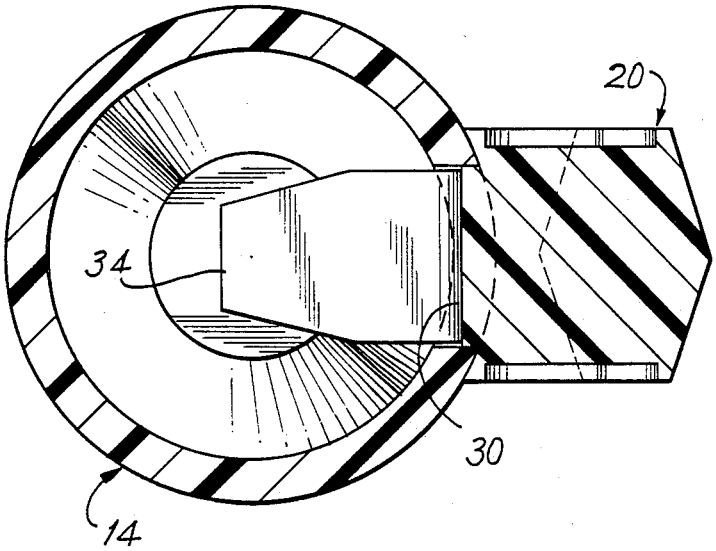
FIG. 4

SNAP-ON CLIP FOR ELONGATED INSTRUMENTS

BACKGROUND OF THE INVENTION

1. Field of the Invention

The invention relates to elongated instruments and preferably writing instruments and the like as well as to a clip assembly therefor which snap-locks onto the cap or body of the instrument to provide convenient attachment to wearing apparel or the like.

2. Description of the Prior Art

Various elongated instruments such as flashlights, tire gauges, small tools, such as pocket screwdrivers and the like, and, preferably, writing instruments such as pens, mechanical pencils, markers, and the like are well known in the art. Heretofore, the usual practice for constructing clips for such instruments consists of fabricating the clip as an integral part of the cap, either by producing them as a single molded entity or by devising a method whereby a separate clip is manufactured from either plastic or metal and is fixably secured in some manner to the body or cap of the instrument.

With respect to the use of integrally molded parts, the gripping tension in the longitudinal extension or arm of the clip dramatically decreases over time to the point where it can no longer maintain the instrument in a secure position. Furthermore, writing instruments made with both molded caps and bodies are highly energy intensive to produce due to the numerous molding operations necessary to produce the required parts.

Various alternate techniques have been utilized to secure the clip to the cap of such writing instruments. One system, disclosed in U.S. Pat No. 2,473,688 relates to a clip associated with a slotted cap for a writing instrument in which the arm of the clip is disposed exteriorly to the cap with two flanges disposed parallel to one another having an S-shaped spring between them and extending through the slot in the cap, which secures the clip within the interior of the cap. The arm of the clip is resilient in order to permit it to flex towards and away from the cap.

Another method of attachment is illustrated in U.S. Pat. No. 1,594,410 wherein a plate is located at the base of the clip which is provided with two lugs and two hook members which, upon being slid through prepunched holes in the cap of a writing instrument, are flattened out against the interior of the cap in order to anchor the assembly in place. As the arm of the clip has a spring nature, the tongue end of the clip bears against the outer surface of the barrel of the writing instrument due to this tension.

U.S. Pat. No. 3,608,154 shows a different procedure for affixing a clip onto the cap of a writing instrument. This clip assembly, consisting of a base and a resilient shank, contains a projection upon the base which is inserted through an opening in the upper end of the cap and secured therein by a resilient retainer ring which is frictionally fitted within the cap. Finally, U.S. Pat. No. 3,453,694 to Hechtle relates to still another method of attachment wherein the serrated base plate of the clip is lockingly engaged into a serrated groove on the outer surface of the hollow cap of a writing instrument.

In the field of support clips for electrical conductors or tubes, U.S. Pat. No. 4,356,987 illustrates a clip consisting of two parallel shanks supported by a crosspiece. Each shank terminates in an outwardly facing, downwardly tapering surface for ease of insertion. Each shank also contains a rectangular groove at its midpoint which is open toward the outside and which, when the elastically interconnected shanks of the clip are forced together and pushed through a bore in the support, locks the clip onto the edges of the bore.

It is apparent from the foregoing that previous efforts at designing efficient clips for writing instruments suffer from several disadvantages. For example, the inexpensive plastic which is often used in such clips lacks sufficient resiliency. After numerous cycles of flexure toward and away from the body of the writing instrument, clips constructed in this manner fail to return to their original, unflexed position, thus losing their usefulness.

Subsequent attempts to design improved clips require either the insertion of a retaining device inside the cap of the writing instrument to anchor the clip into the cap or some alternate means by which projections upon the base of the clip could be bent back against the interior of the cap to hold the clip in place. The construction of writing devices using clips of this type requires more energy and/or a greater number of manufacturing steps.

We have discovered a new clip and system for attachment to elongated instruments such as writing instruments which avoids the aforementioned disadvantages of the prior art.

SUMMARY OF THE INVENTION

The invention relates to a clip assembly for an elongated instrument which comprises a base portion, a resilient elongated member extending from the base portion, and means extending from said base portion configured and dimensioned for insertion into at least one aperture defined by the elongated instrument for snap-locking engagement therewith and attachment of the base portion thereto. The base portion and resilient elongated member are configured and dimensioned such that attachment of the base portion to the elongated instrument will retain the elongated member in generally parallel relation and sufficiently close proximity with the elongated instrument for attachment of the instrument to wearing apparel or the like.

Advantageously, the elongated instrument is a writing instrument, a flashlight, a tire air pressure gage, or a small tool. Typical writing instruments includes pens, mechanical pencils, or indelible marking instruments. Preferably, the clip assembly is constructed of plastic or metal.

An alternate embodiment of the invention relates to a clip assembly for a writing instrument which comprises a base portion, a resilient elongated member extending from the base portion, and means for attachment of the clip assembly to the writing instrument. The attachment means extending from the base portion are configured and dimensioned for insertion into at least one aperture defined by a wall portion of the writing instrument for snap-locking engagement therewith and attachment of the base portion thereto. The base portion and resilient elongated member are configured and dimensioned such that attachment of the base portion to the writing instrument will retain the elongated member in generally parallel and sufficiently close proximity with the writing instrument for attachment of the writing instrument to wearing apparel or the like.

Preferably, the snap-locking means comprises at least one polygonal member having a medial groove extending along its length from the base portion to the end of the polygonal member. Alternatively, the snap-locking means comprises at least two generally arcuate members each having a medial groove extending from the base portion to the end of the generally arcuate member. The base portion, elongated member, and snap-locking means may be integrally molded of a resilient plastic material, such as polypropylene, acetal, nylon, or polyester, for attachment to a writing instrument such as a pen, mechanical pencil, or indelible marker.

The invention also relates to clip assembly for a pen which comprises a base portion a resilient elongated member extending from the base portion, and at least two generally arcuate members each extending from the base portion and having a medial groove extending from the base portion to the end of the arcuate members. The at least two generally arcuate members are configured and dimensioned for insertion into at least two apertures defined by the pen for snaplocking engagement therewith and attachment of the base portion of the clip thereto. The base portion, resilient elongated member, and at least two generally arcuate members are integrally molded of a resilient plastic material. The base portion and resilient elongated member are configured and dimensioned such that attachment of the base portion to the pen will retain the elongated member in generally parallel and sufficiently close proximity to the pen for attachment of the pen to wearing apparel or the like.

Advantageously, the at least two generally arcuate members each comprise at least two half-conical protrusions integrally molded to the base portion and elongated member for resilient relative movement toward and away from each other for snap-locking engagement of the corresponding apertures of the pen. Also, the snap-locking means are configured and dimensioned so as to prevent relative rotation of the base portion and elongated member around the longitudinal axis of the pen. Usually, the pen comprises a cap member and a body member and the clip assembly is attached as described above to the cap member.

Another aspect of the invention relates to a writing instrument comprising a body member having a reservoir of writing medium and writing tip means, a cap member configured and dimensioned for mating engagement with the body member, and a clip comprising a base portion, a resilient elongated member extending from the base portion, and means extending from the base portion configured and dimensioned for insertion into at least one aperture defined by the body or cap member of the writing instrument for snap-locking engagement therewith and attachment of the base portion thereto. The base portion and resilient elongated member are configured and dimensioned such that attachment of the base portion to the body or cap member of the writing instrument will retain the elongated member in generally parallel and sufficiently close proximity to the writing instrument for attachment of the writing instrument to wearing apparel or the like.

A preferred aspect of the invention relates to a pen comprising a body member having a reservoir of ink and a ball point tip, a cap member configured and dimensioned for mating engagement with the body member, and a clip comprising a base portion, a resilient elongated member extending from the base portion, and at least two generally arcuate members each extending from the base portion and each having a medial groove extending from the base portion to the end of the arcuate member. The at least two generally arcuate members configured and dimensioned for insertion into at least two apertures defined by the cap member for snap-locking engagement therewith and attachment of the base portion thereto. The base portion, resilient elongated member, and at least two generally arcuate members are integrally molded of a resilient plastic material, with the base portion and resilient elongated member being configured and dimensioned such that attachment of the base portion to the cap member will retain the elongated member in generally parallel and sufficiently close proximity with the cap for attachment of the pen to wearing apparel or the like.

The pen also includes a button on the end of the pen cap and a second button on the end of the pen body, wherein the buttons are respectively molded from a resilient plastic and said pen cap and body are extruded from the same or a different plastic.

In an alternate embodiment, the base portion contains two pairs of medially grooved shanks which are integrally fixed upon the clip and the members of each pair of shanks are resiliently movable toward and away from their opposite member. Each pair of shanks is tapered inwardly and possesses a barbed shoulder upon the surface proximal to the base plate of the clip. As the width of the medial groove between each pair of shanks is narrowed by moving its members toward one another, an interference fit is created between the upper barbed surface of each pair of shanks and the interior surface of the hollow cap when the shanks are inserted through parallel bores in the surface of the hollow cap of a writing instrument. Once inserted, the shanks return to their original respective positions and create an interference lock fit with the cap, holding the clip tightly against the surface of the cap.

As can be seen from the foregoing, the present invention presents several advantages over the prior art. Because it is not manufactured integral with the cap, the clip may be constructed of a sturdier and more resilient material than the body of the writing instrument in order to obtain a greater useful life from the assembly. Also, utilizing the interference snap-lock fit of the clip into the hollow cap of a writing instrument saves time due to the reduced number of steps required for this procedure. Less equipment is required to perform this attachment than was necessary in the prior art. The production of the component parts of the assembly by means of an extrusion process rather than by molding also allows for a simplification of the manufacturing procedure with a concurrent decrease in production cost and time spent manufacturing each assembly.

This quick and efficient insertion technique serves to reduce the number of steps previously required for this process and thus lends itself to high speed production techniques with a savings in time and cost.

Accordingly, the present invention provides a clip assembly for writing instruments such as ballpoint pens, fountain pens, mechanical pencils, markers, or the like, wherein such an assembly is inexpensive to construct and is designed so that it may be easily and securely attached to the hollow cap or body of the writing instrument.

BRIEF DESCRIPTION OF THE DRAWINGS

Further benefits and advantages of the invention will become apparent from a consideration of the following description given with reference to the accompanying drawing figures which specify and show preferred embodiments of the present invention.

FIG. 3 is a cross-sectional view taken along lines 3—3 of FIG. 2;

FIG. 3A is a detailed unassembled view illustrating only the clip to writing instrument connection; and FIG. 4 is a transverse cross-sectional view taken along lines 4—4 of FIG. 3

DETAILED DESCRIPTION OF THE PREFERRED EMBODIMENTS

Figure 1:
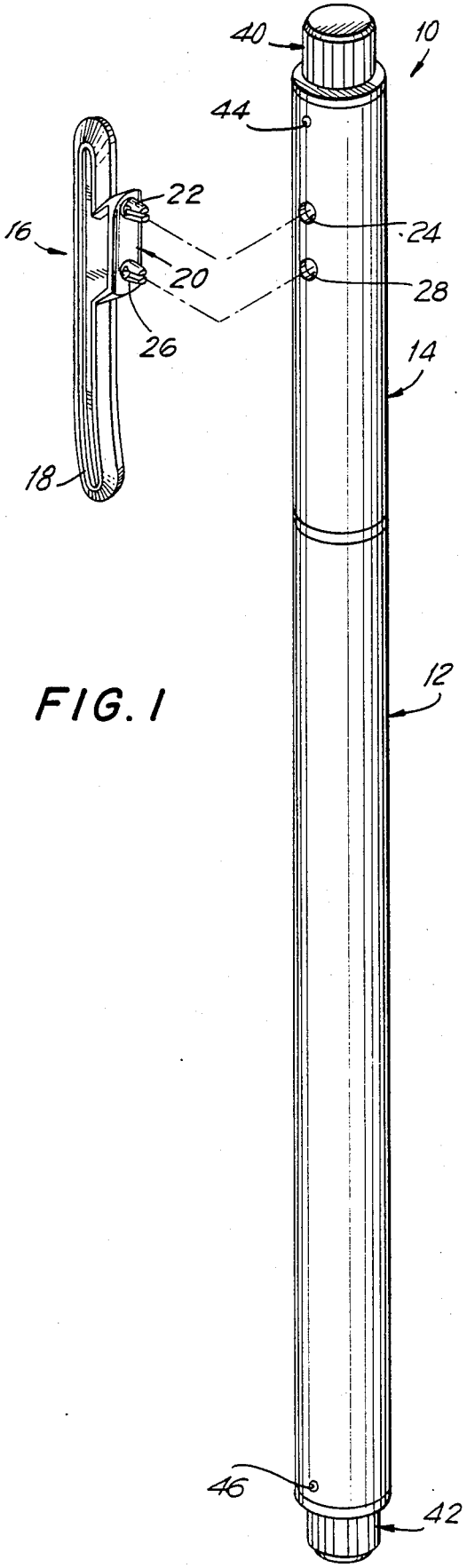
FIG. 1 is an exploded view showing the clip assembly and the body of the writing instrument prior to the assembly of the clip and the cap.
Figure 2:
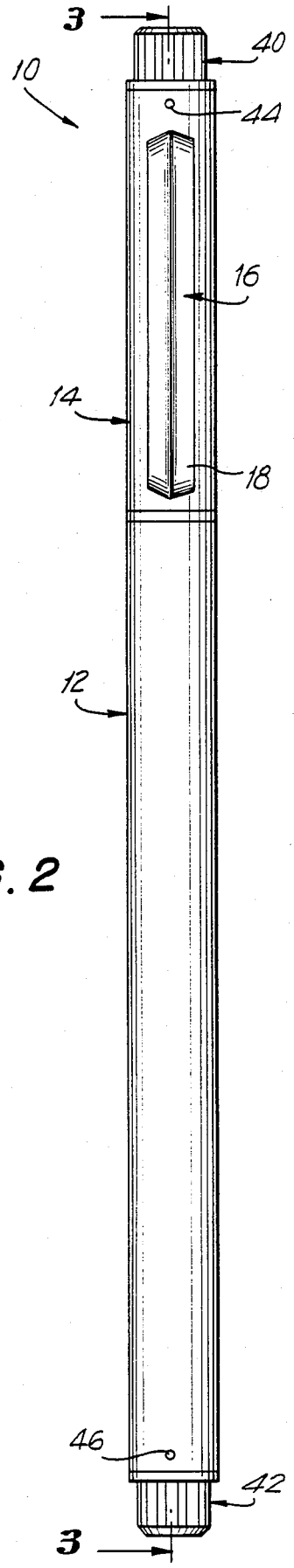
FIG. 2 is a front elevation of the assembled clip and writing instrument.

Referring initially to FIGS. 1 and 2, there is illustrated a pen 10 constructed according to the present invention. FIG. 1 is an exploded view of the pen 10 prior to attachment of clip 16, while FIG. 2 is an illustration of the pen 10 after assembly with the clip 16.

In these FIGS., the pen 10 is comprised of a pen body 12 and an upper cap 14, configured for attachment of a clip 16 for use in readily securing the pen 10 to articles of clothing, pockets or the like.

The plastic molded clip 16 consists of a resilient spring arm 18 having a base portion 20 formed integral therewith. The base portion 20 includes two sets of resilient shanks 22, 26 which are intended to be inserted into two parallel bores 24, 28 in the hollow cap 14 of the pen 10.

As illustrated by the cross-sectional view of FIG. 3, each set of shanks 22, 26 is bisected by a medial groove 30, 32 which allows the bifurcated portions to move toward and away from one another. The two sets of shanks 22, 26 project perpendicularly from the base portion 20, of which they are an integral part, and possess tapered ends 34, 36 to facilitate insertion into the bores 24, 28 in cap 14.

As the transverse cross-sectional view of FIG. 4 clearly shows, each bifurcated portion of both pairs of shanks 22, 26 possesses a barbed shoulder 38 at its lower (i.e. base) end proximal to the base portion 20 which serves to provide an interference fit for snap-lock engagement when the shanks 22, 26 are inserted through the bores 24, 28 in the hollow cap 14. This causes the base 20 of the clip 16 to be retained snugly against the cap 14 and substantially prevents any movement from this position.

In operation, the clip 16 and particularly its resilient spring arm 18 may be repeatedly moved toward and away from the pen body 12 while returning to its original unstressed position when not in use. Materials are selected for construction of the clip 16 on the basis of their resiliency, i.e., their ability to return to their original position. Also, such materials must have a sufficient fatigue strength or endurance limit such that it can withstand numerous cycles of use.

As previously discussed the preferred embodiment is a plastic molded clip 16. Polypropylene is the plastic of choice, however acetal, nylon or polyester may also be utilized. Alternate embodiments include the use of metal clips constructed of such metals or steel, brass or gold. Such clips are most often used with metal pen bodies but may, when desired, also be attached to pens constructed of plastic.

As stated hereinabove, the normal method of manufacture of plastic prior art pens is to mold all the component parts of the pen but these operations ulitize a great deal of energy. Accordingly, a feature of the present invention is the reduction of the expenditure of energy necessary for the manufacture of this pen by extruding as many of the component parts as possible. This reduces the time and energy necessary to manufacture each item, as the body, cap and parts of similar configuration are simply extruded and then cut to the correct size. This creates a pen which is capable of being produced rapidly and inexpensively while maintaining an aesthetically pleasing appearance.

Referring once again to FIG. 3, the upper cap 14 and lower pen body 12 are sealed by means of molded plastic buttons 40, 42 which may be colored so as to indicate the color of ink in the pen. The button 40 in the pen cap 14 provides a seal against the entry of air into the cap which tends to dry the surface of the writing tip 50, thus causing the pen 10 to clog. The buttons 40, 42 are held in the pen 10 by means of cross-pins 44, 46 which extend through the exterior surface of the pen 10 and into the base of each button 44, 46. This prevents the accidental removal of a button 44 or 46 from the pen cap 14 or the pen body 12.

In a normal construction of preferred embodiment of the invention, button 40 is securably attached to pen cap 14 by cross-pin 44, while button 42 is securably attached to pen body 12 by cross-pin 46. Pen cap 14 also includes the clip assembly 16 attached as described hereinabove. Pen cap 14 can also includes optional sealing element 48, while pen body 12 contains writing tip 50, and ink reservoir 52. When not in use, closure of the pen can be made by inserting cap 14 over the writing tip 50 of pen body 12 in a matter which is well known to those skilled in the art.

FIG. 3 also illustrates the optional molded sealing element 48 which serves to minimize the amount of air which comes in contact with the writing tip 50. One embodiment of the invention utilizes a water based ink for writing, and exposure of the writing tip 50 to the atmosphere will, in time, lead to the evaporation of the water in the ink reservoir 52. This causes the writing tip 50 to dry up and leads to difficulties in restoring the flow of ink through the pen 10. Therefore, the presence of the sealing element 48 prevents this problem from occurring.

As illustrated by the cross-sectional view of FIG. 3 the clip 16 and cap 14 may easily be assembled without the use of riveting machines or other attachment devices previously required for attaching clips to other commercially available writing instruments. Therefore the assembly may be done with a minimal amount of mechanical equipment, which is an additional advantage of the present invention.

An alternative embodiment relating to the use of a separate clip 16 and cap 14 is the use of an extra tough and resilient plastic for the clip which is not required for the construction of the body or cap of the writing instrument itself. By limiting the use of this stronger plastic possessing a superior fatigue life to the clip 16 above, an overall savings in the cost of the plastic is achieved. Two different colored plastics may also be used for the clip 16 and the pen 10 in order to provide an aesthetically pleasing two-tone color combination. Also since the clip 16 is selflocking, this obviates the need for additional parts necessary to retain the clip 16 within the pen cap 14.

While it is apparent that the invention herein disclosed is well calculated to fulfill the desired results, it will be appreciated that numerous modifications and embodiments may be devised by those skilled in the art, and it is intended that the appended claims cover all such modifications and embodiments as fall within the true spirit and scope of the present invention.

We claim:

1. A clip assembly for an elongated instrument which comprises:

(a) a base portion;

(b) a resilient elongated member extending from said base portion; and (c) at least two spaced apart attachment means, each attachment means including at least two leg members spaced apart from each other by a medial groove and extending in a substantially perpendicular direction from said base portion and being resiliently movable toward and away from each other, at least a portion of said leg members having an arcuate outer surface portion and each pair of leg members being dimensioned for insertion through at least one correspondingly configured aperture defined by the elongated instrument, at least said arcuate surface portion of each leg member dimensioned for contacting snap-locking engagement therewith by resilient movement of said leg members toward and away from each other during insertion thereof into said corresponding aperture, thereby providing attachment of said base portion thereto, said base portion and resilient elongated member being configured and dimensioned such that attachment of said base portion to said elongated instrument will retain said elongated member in generally parallel relation and sufficiently close proximity with the elongated instrument for releasable attachment of said instrument to wearing apparel or the like.

2. The clip assembly according to claim 1 wherein said elongated instrument is selected from the group consisting of a writing instrument, a flashlight, a tire air pressure gauge, and a small tool.

3. The clip assembly according to claim 1 wherein said elongated instrument is selected from the group consisting of a pen, a mechanical pencil and an indelible marking instrument.

4. The clip assembly according to claim 1 wherein said clip assembly is constructed of a material which is selected from the group consisting of plastic and metal.

5. A clip assembly for a writing instrument which comprises:

(a) a base portion;

(b) a resilient elongated member extending from said base portion; and (c) integral means for attachment of said clip assembly to the writing instrument, said means including at least two spaced pairs of leg members, each pair of leg members spaced apart from each other by a medial groove and extending in a substantially perpendicular direction from said base portion and being resiliently movable toward and away from each other, at least a portion of said leg members having an arcuate outer surface and being configured and each pair of leg members being dimensioned for insertion through at least one correspondingly configured aperture defined by a wall portion of said writing instrument and dimensioned for snap-locking engagement therewith and attachment of said base portion thereto, said base portion, said resilient elongated member and said leg members being configured and dimensioned such that attachment of said base portion to said writing instrument will retain said elongated member in generally parallel and sufficiently close proximity with said writing instrument for attachment of said writing instrument to wearing apparel or the like.

6. The clip assembly according to claim 5 wherein said snap-locking means comprises at least one polygonal member having a medial groove extending along its length from said base portion to the end of said polygonal member.

7. The clip assembly according to claim 5 wherein said snap-locking means comprises at least two generally arcuate members each having a medial groove extending from said base portion to the end of said generally arcuate members.

8. The clip assembly according to claim 5 wherein said base portion, elongated member, and snap-locking means are integrally molded of a resilient plastic material.

9. The clip assembly according to claim 8 wherein said resilient plastic material is selected from the group consisting of polypropylene, acetal, nylon, and polyester.

10. The clip assembly according to claim 5 wherein said writing instrument is selected from the group consisting of a pen, mechanical pencil, and an indelible marker.

11. A clip assembly for a writing instrument which comprises:

(a) a base portion;

(b) a resilient elongated member extending from said base portion; and (c) at least two attachment members spaced apart from each other, each attachment member extending substantially perpendicularly from said base portion and integral therewith, each member having a medial groove extending at least over a substantial portion of the length thereof to define a pair of spaced apart leg members resiliently movable toward and away from each other, each of said leg members having an arcuate outer surface and each pair of leg members being dimensioned for insertion in interference relation through at least one corresponding aperture defined by said writing instrument for snap-locking engagement therewith by movement of said leg members toward and away from each other during insertion thereof into said respective aperture thereby providing attachment of said base portion thereto, said base portion, said resilient elongated member and said attachment being integrally molded of a resilient plastic material and said base portion and resilient elongated member being configured and dimensioned such that attachment of said base portion to said writing instrument by insertion of said attachment members into said respective apertures will retain said elongated member in generally parallel and sufficiently close proximity with said writing instrument for attachment of said writing instrument to wearing apparel or the like.

12. The clip assembly according to claim 11 wherein said at least two generally arcuate members each comprise at least two half-conical protrusions integrally molded to said base portion and said elongated member for resilient relative movement toward and away from each other for snap-locking engagement of said corresponding apertures of said pen.

13. The clip assembly according to claim 11 wherein said snap-locking means are configured and dimensioned so as to prevent relative rotation of said base portion and said elongated member around the longitudinal axis of said pen.

14. The clip assembly according to claim 11 wherein said pen comprises a cap member and a body member and wherein said clip assembly is attached to said cap member by at least two generally arcuate members each extending from said base portion and having a medial groove extending in a substantially perpendicular direction from the base portion.

15. A writing instrument comprising:

(a) a body member having a reservoir of writing medium and writing tip means;

(b) a cap member configured and dimensioned for attachment to said body member; and (c) a clip comprising:

(i) a base portion;

(ii) a resilient elongated member extending from said base portion; and (iii) integral attachment means including at least two spaced apart pairs of leg members each pair of leg members spaced apart from each other by a medial groove and extending from said base portion in a substantially perpendicular direction therefrom, at least a portion of said leg members having an arcuate outer surface and dimensioned for insertion in interference relation through at least corresponding pair of apertures defined by said body or cap member of said writing instrument for snap-locking engagement therewith by resilient movement of said leg members toward and away from each other during insertion thereof into said apertures, and thereby providing attachment of the base portion thereto, said base portion, said resilient elongated member and said attachment means being configured and dimensioned such that attachment of said base portion to said body or cap member of said writing instrument by insertion of said attachment means into said respective apertures will retain said elongated member in generally parallel and sufficiently close proximity with said writing instrument for attachment of said writing instrument to wearing apparel or the like.

16. The writing instrument according to claim 15 wherein said writing instrument is selected from the group consisting of a pen, mechanical pencil, and an indelible marker.

17. The writing instrument according to claim 15 wherein said snap-locking means of said clip comprises at least one polygonal member having a medial groove extending along its length from said base portion to the end of said polygonal member.

18. The writing instrument according to claim 15 wherein said snap-locking means of said clip comprising at least two members each having an arcuate outer configuration and a medial groove extending from said base portion to the end of each arcuate member.

19. A pen comprising:

(a) a body member having a reservoir of ink and a ball point tip;

(b) a cap member configured and dimensioned for mating engagement with said body member; and (c) a clip comprising:

(i) a base portion;

(ii) a resilient elongated member extending from said base portion; and (iii) at least two spaced apart attachment means, each attachment means extending from said base portion in a direction substantially perpendicular thereto and each attachment means including at least two leg members spaced apart from each other by a medial groove, each leg member having an arcuate outer surface portion and being dimensioned for insertion in interference relation through at least two correspondingly positioned apertures defined by said cap member for snap-locking engagement therewith by resilient movement of said leg members toward and away from each other during insertion thereof into said respective apertures, thereby providing attachment of said base portion thereto, said base portion, said resilient elongated member, and said attachment members being integrally molded as a unitary attachment means of a resilient plastic material, and said base portion, said resilient elongated member and said attachment members being configured and dimensioned such that attachment of said base portion to said cap member will retain said elongated member in generally parallel and sufficiently close proximity with said cap for attachment of said pen to wearing apparel or the like.

20. The pen according to claim 19 wherein said at least two generally arcuate members of said clip each comprise two half conical protrusions, each of which is integrally molded to said base portion and said elongated member for resilient relative movement toward and away from each other for engagement of said corresponding apertures of said pen.

21. The pen according to claim 19 wherein said arcuate members of said clip are configured and dimensioned so as to prevent relative rotation of said base portion and said elongated member around the longitudinal axis of said pen.

22. The pen according to claim 19 further comprising a button on the end of the pen cap and a second button on the end of the pen body, each of said buttons being retained in position by pin means.

23. The pen according to claim 22 wherein said clip and buttons are molded from a resilient plastic and said pen cap and body are extruded from the same or a different plastic.

* * * * *